United States Patent [19]

Schaller

[11] 4,361,068

[45] Nov. 30, 1982

[54] BRIDGE DEVICE FOR STRINGED INSTRUMENT

[76] Inventor: Helmut F. K. Schaller, Postfach 1225, D-8501 Feucht 1, Fed. Rep. of Germany

[21] Appl. No.: 192,933

[22] Filed: Oct. 1, 1980

[30] Foreign Application Priority Data

Aug. 7, 1980 [DE] Fed. Rep. of Germany ..... 3029951

[51] Int. Cl.[3] ..... G10D 3/04

[52] U.S. Cl. ..... 84/299; 84/307

[58] Field of Search ..... 84/297 R, 298–299, 84/307, 267

[56] References Cited

U.S. PATENT DOCUMENTS

| | | | |
|---|---|---|---|
| 2,918,837 | 12/1959 | Webster | 84/312 |
| 3,427,916 | 2/1969 | Fender | 84/267 |
| 4,031,799 | 6/1977 | Fender | 84/307 |
| 4,135,426 | 1/1979 | Rickard | 84/1.16 |
| 4,248,126 | 2/1981 | Lieber | 84/299 |
| 4,281,576 | 8/1981 | Fender | 84/298 |

*Primary Examiner*—Lawrence R. Franklin

*Attorney, Agent, or Firm*—McCormick, Paulding & Huber

[57] ABSTRACT

A bridge device for a guitar or similar stringed instrument includes a base plate adapted to be fixed to the instrument and a plurality of individual bridge elements each engageable with a respective one of the strings. The bridge elements are supported from the base plate and are adjustable relative thereto in three different directions—that is, along the length of the associated string, crosswise of the associated string in a direction parallel to the base plate and crosswise of the associated string in a direction perpendicular to the base plate. The adjustment means are provided in such a way as to obtain the desired three-way adjustment capability with relatively simple and easily manipulated parts despite the space limitations imposed by the usual relatively small size of a bridge.

5 Claims, 2 Drawing Figures

BRIDGE DEVICE FOR STRINGED INSTRUMENT

BACKGROUND OF THE INVENTION

This invention relates to stringed musical instruments, and deals more particularly with a bridge device for such an instrument which is adjustable to vary the location relative to the remainder of the instrument of the point at which each individual string is supported by the bridge.

On some known bridge devices two possibilities for adjustment are provided. That is, by adjustment of a bridge element in the longitudinal direction of its string the scale of the instrument relative to that string can be adjusted and by this a possible untrueness of the frets can be compensated. Furthermore, on such known bridge devices the displacement of the strings from the fingerboard can be regulated by adjustment of the bridge elements crosswise of the strings and in directions perpendicular to the bridge base plate. This latter adjustment makes it possible to adapt, for example, the string course to the arching of the fingerboard or to set individual strings higher or lower because of reasons of playing techniques. In another known bridge device the bridge elements are adjusted crosswise of the strings in directions parallel to the bridge base plate in order to vary the displacement of the strings relative to each other.

This invention has the objective of providing a bridge device which has bridge elements with three possibilities of adjustment so as to render possible an adjustment of the scaling, an adjustment of the distance between the strings, and an adjustment of the distance of the strings from the fingerboard.

Since bridge devices for guitars and similar stringed musical instruments are usually of relatively small size, a further object of the invention is to provide a bridge device which meets the above objective of a three-way adjustment capability while nevertheless being relatively easy to manufacture and to operate despite the narrow space limitations involved.

Other objects and advantages of the invention will be apparent from the following detailed description and from the accompanying drawings.

SUMMARY OF THE INVENTION

The invention resides in a bridge device for a guitar or similar stringed instrument comprising a base plate adapted for attachment to a guitar, a plurality of bridge elements each engaging a respective one of the instrument strings, and a means for adjustably supporting the bridge elements from the base plate so that each element may be adjustably positioned independently of the other elements in three different directions relative to the base plate, these directions being: (1) the direction extending longitudinally of the associated string, (2) the direction extending crosswise of the string and generally perpendicular to the base plate, and (3) the direction extending crosswise of the string and generally parallel to the base plate.

The invention further resides in the construction of the bridge device whereby the base plate includes a forward portion with a top surface and a tailpiece at the rear end of the forward portion extending some distance above the top surface of the forward portion, a plurality of pedestals located above the top surface with each adjustable longitudinally of an associated string by means of a longitudinal screw passing through the tailpiece and threadably received by the pedestal, by a second screw on each pedestal which extends crosswise of the associated string generally parallel to the base plate and which receives an associated bridge element in the form of a grooved roller threadably carried by the second screw, and a pair of third screws threadably carried by each pedestal and passing through the pedestal in directions generally perpendicular to the top surface of the forward base plate portion and which engage such top surface to vertically support and position the pedestal.

The invention still further resides in the two third screws of each pedestal being located on opposite sides of the axis of the associated second screw so as to reduce or eliminate bending moments on the longitudinal screw due to string pressure, and to the forward base plate portion including elongated grooves for receiving the lower ends of the third screws so as to restrain the pedestals against lateral movement relative to the base plate.

DETAILED DESCRIPTION OF THE PREFERRED EMBODIMENT

Figure 1:
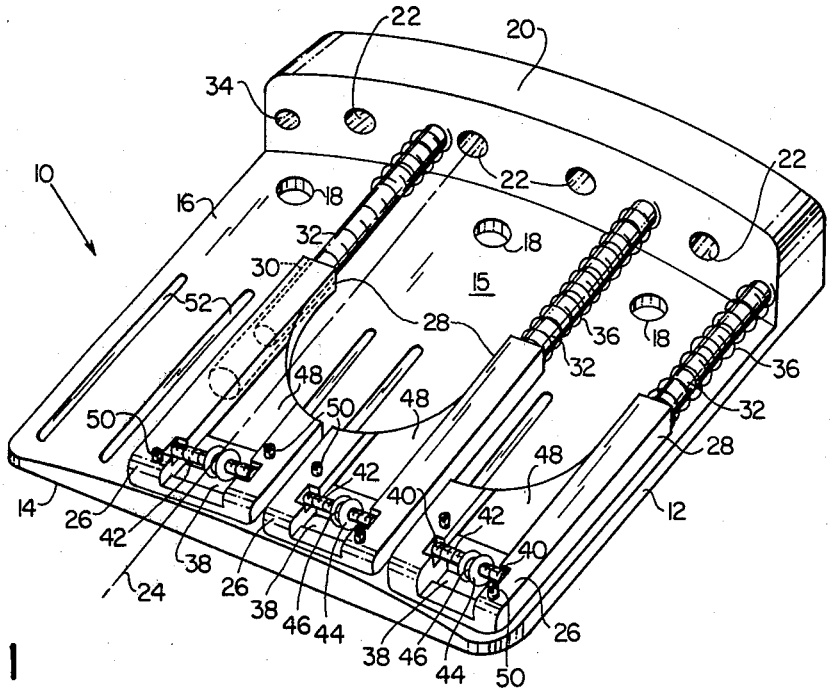
FIG. 1 is a perspective top view showing a bridge device embodying the invention and wherein one of the pedestals and its associated parts are omitted.

Turning to the drawings, a bridge device, indicated generally at 10, embodying the invention is there shown and comprises a base plate 12 having a plain or generally flat bottom surface 14 which in use of the bridge device is intended to engage the top surface of the instrument with which it is used. The base plate has a forward portion 15 with a top surface 16. At the rear end of the forward portion 15, that is the end farthest from the machine heads or tuning pegs of the instrument, the base plate includes a tailpiece 20 which is made of one piece with the forward portion 15 and which extends slightly upwardly from the top surface 16 of the forward portion. Both the top surface 16 and the tailpiece 20 are slightly curved about an axis of curvature generally parallel to the longitudinal directions of the strings. The location of one of the strings is indicated by the broken line 24.

The tailpiece 20 has four holes 22, 22 passing therethrough in directions parallel to the top surface 16. A respective one of the four strings of the instrument passes through each of the holes 22, 22 and each such string includes a terminal bead, button or other stop which engages the rear surface of the tailpiece to hold the string to the tailpiece in the tensioned condition of its string. Three holes 18, 18 also pass vertically through the forward portion of the base plate for receiving screws (not shown) for fastening the base plate to the instrument with which it is used.

The base plate 12 carries four pedestals 26, 26 (of which only three are shown in FIG. 1) located above the top surface 16 of the forward portion 15. Each pedestal 26 consists of a generally flat plate having an extension 28 at one side and directed toward the tailpiece 20. The extension 28 of each pedestal 26 has a threaded opening 30, running parallel to the longitudinal direction of the associated string, which threadably receives a longitudinal screw 32. Each screw 32 passes loosely through an associated one of four openings 34, 34 in the tailpiece 20 and has a head (not shown) at its rear end which is engageable with the rear surface of the tailpiece to limit its forward movement and which is provided with a slot or other means for rotating the screw. A helical compression spring 36 surrounds each screw 32 and at opposite ends engages respectively the tailpiece 20 and the rear end of the associated extension 28 so as to urge the associated pedestal 28 away from the tailpiece 20. Therefore, by rotating a longitudinal screw 32 in one direction or the other it may be threaded more or less deeply into its associated pedestal extension 28 to move the pedestal in one direction or the other relative to the base plate in a direction parallel to the longitudinal direction of the associated string.

Each pedestal 26 has a longitudinally extending recess 48 in its upper portion located laterally in the middle of the pedestal so as to define two side ribs 49, 49 on opposite sides thereof. One of these side ribs 49, 49 is longer than the other and serves as part of the extension 28. In the opposite side ribs 49, 49 defining the recess 48, and at the forward end of the pedestal, are two notches 40, 40 which receive a second screw 42 extending generally crosswise of the associated string and in a direction generally parallel to the top surface 16 of the base plate. This second screw 42 in turn carries a bridge element in the form of a roller 44 threaded onto the screw and having a circumferential groove 46 which receives the associated string. Below the screw 42 the recess 48 includes a further essentially rectangular recess 38 for accommodating the bottom portion of the roller 44. The roller 44 forms the actual bridge element for its associated string, and by turning the roller on the second screw 42 it can be adjusted relative to the base plate in the axial direction of the second screw 42, that is in a direction crosswise of the associated string and generally parallel to the top surface of the base plate forward portion. By this form of adjustment it is therefore possible to change the spacing of the strings relative to each other. Further, each roller 44 projects only a small distance above the top surface of its pedestal 26 and the longitudinally extending recess 48 rearwardly of the roller provides clearance for the associated string and prevents the string from engaging the pedestal. Also, the fact that each longitudinal screw 32 is laterally offset from the center of its associated pedestal, and received in the pedestal extension 28, permits the screw to be at about the same level, measured perpendicularly to the top surface 16 of the forward base portion 15, as the associated string without interfering with the string.

Figure 2:
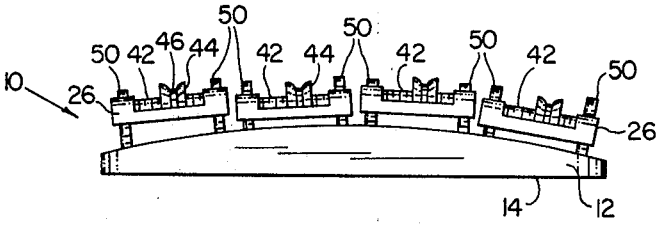
FIG. 2 is a front elevational view of the bridge device taken looking in the direction of the arrow A of FIG. 1.

Close to each of the two ends of each second screw 42 is a third screw 50 which is threadably received in a threaded opening passing through the associated pedestal rib 49 and which is arranged with its axis generally perpendicular to the top surface 16 of the base forward portion 15. Preferably, the two third screws 50, 50 of each pedestal 26 are arranged so as to be on opposite sides of the axis of the associated second screw 42. This allows them to be accommodated in a minimum amount of pedestal space and yet substantially or entirely eliminates any bending moment on the associated longitudinal screw 32 due to the string pressure bearing downwardly on the roller 44. The two third screws 50, 50 of each pedestal extend downwardly beyond the lower surface of the pedestal and at their lower ends engage the top surface of the forward base plate portion 15. The top surface 16 in turn includes a plurality of elongated channels or grooves 52, 52, one for each third screw 50, which receive the lower ends of the associated screws 50, 50 so as to prevent the pedestals 26, 26 from moving laterally relative to the base plate. At its upper end, each third screw 50 includes a slot or other means for receiving a turning tool, and by turning the two third screws 50, 50 of each pedestal in one directin or the other, the distance between the pedestal and the top surface of the base plate forward portion may be varied, as will be evident from FIG. 2. Therefore, by this means of adjustment the heighth of each roller 14 relative to the base plate may be adjusted to adjust the position of the associated string relative to the fingerboard.

I claim:

1. A bridge device for guitars and other stringed musical instruments, said device comprising: a base plate adapted to be fixed to an instrument, said base plate including a forward portion with a top surface and a tailpiece located at the rear of said forward portion and extending upwardly beyond said top surface thereof, a plurality of pedestals located side-by-side above said top surface and spaced from one another crosswise thereof, each of said pedestals having a longitudinally extending recess in its upper portion located laterally in the middle thereof so as to define two side ribs on opposite sides thereof, said tailpiece for each of said pedestals having two openings spaced from one another crosswise of said top surface, and a plurality of longitudinal adjustment screws, each of said longitudinal adjustment screws passing through one of said two openings in said tailpiece associated with an associated one of said pedestals and threadably received by one of said ribs of said associated pedestal for adjustably longitudinally positioning said pedestal relative to said base plate in response to rotation of said longitudinal adjustment screw, the other of said two tailpiece openings associated with each pedestal serving to receive an associated string, each of said pedestals having adjacent its forward end a screw carried by and extending between its two side ribs, said second screw of each of said pedestals threadably receiving a roller having a circumferential groove for receiving a string associated with said pedestal whereby said roller may be adjusted crosswise of said string in a direction generally parallel to said base plate top surface by rotating it relative to said second screw, each of said pedestals further having a pair of third screws threadably engaged respectively with said side ribs of said pedestal with their axes generally perpendicular to said base plate top surface and with their lower ends engaging said top surface, said top surface of said base plate including a plurality of elongated grooves extending longitudinally of said base plate with each of said grooves receiving the lower end of a respective one of said third screws.

2. A bridge device as defined in claim 1 further characterized by each of said pair of third screws of each pedestal being located on opposite sides of the axis of said second screw carried by said pedestal.

3. A bridge device as defined in claim 1 or 2 further characterized by each of said pedestals having another recess located immediately below its said second screw and located in the bottom of said longitudinally extending recess for accommodating said roller received on said second screw.

4. A bridge device for guitars and other stringed musical instruments, said device comprising: a base plate adapted to be fixed to an instrument, a plurality of bridge elements each adapted to engage a respective one of the strings of the instrument, and means for supporting said bridge elements from said base plate whereby each of said bridge elements is individually adjustable relative to said base plate (1) along the longitudinal direction of its associated string, (2) crosswise of its associated string in a direction perpendicular to said base plate, and (3) crosswise of its associated string in a direction generally parallel to said base plate, said base plate including a forward portion with a top surface and a tailpiece located at the rear end of said forward portion and extending upwardly beyond said top surface thereof, said tailpiece having means for holding thereto the associated ends of a plurality of strings each associated with a respective one of said bridge elements, a plurality of pedestals located above said top surface of said forward base plate portion, a plurality of longitudinal adjustment screws, each of said longitudinal adjustment screws passing through said tailpiece parallel to the direction of the associated string and threadably received by an associated one of said pedestals for adjustably positioning said pedestal relative to said base plate in the longitudinal direction of the associated string in response to rotation of said longitudinal adjustment screw, each of said pedestals having mounted thereon a second screw extending crosswise of the associated string in a direction generally parallel to said base plate, and each of said bridge elements comprising a roller having a circumferential groove for receiving its associated string and which roller is threadably received on said second screw of an associated one of said pedestals whereby said roller may be adjusted crosswise of said string in a direction generally parallel to said base plate by rotating it relative to said second screw, each of said pedestals being vertically supported on said forward portion of said base plate by a pair of third screws threadably engaged with said pedestal with their axes generally perpendicular to said base plate and with their lower ends engaging said top surface of said forward base plate portion, said top surface of said forward base plate portion including a plurality of elongated grooves extending in directions generally parallel to the longitudinal directions of the associated strings with each of said grooves receiving the lower end of a respective one of said third screws.

5. A bridge device as defined in claim 4 further characterized by each of said pedestals being in the form of a generally flat plate having a recess for receiving its associated one of said rollers.

* * * * *